United States Patent [19]

Murphy

[11] 3,965,634

[45] June 29, 1976

[54] MODULAR BUILDING

[75] Inventor: Wesley T. Murphy, Auburn, N.Y.

[73] Assignee: Vercon Products, Inc., Charlotte, N.C.

[22] Filed: Oct. 26, 1973

[21] Appl. No.: 410,076

Related U.S. Application Data

[63] Continuation of Ser. No. 160,018, July 6, 1971, abandoned, which is a continuation-in-part of Ser. No. 85,533, Oct. 30, 1970, abandoned.

[52] U.S. Cl. ..... 52/403; 52/584; 52/732

[51] Int. Cl.[2] ..... E04B 1/68

[58] Field of Search ..... 52/403, 464, 481, 496, 52/584, 629, 638, 760; 85/5 R, 49; 151/41.75; 24/87 TB

[56] References Cited

UNITED STATES PATENTS

| | | | |
|---|---|---|---|
| 1,369,949 | 3/1921 | White | 52/688 |
| 1,885,329 | 11/1932 | Cherdron et al. | 52/404 |
| 1,885,330 | 11/1932 | Cherdron et al. | 52/496 X |
| 2,054,189 | 9/1936 | Bemis | 52/481 X |
| 2,164,138 | 6/1939 | London | 52/407 |
| 2,268,907 | 1/1942 | Scott | 52/494 |
| 2,275,683 | 3/1942 | Rutledge | 24/87 TB |
| 2,712,917 | 7/1955 | Flora et al. | 151/41.75 X |

FOREIGN PATENTS OR APPLICATIONS

| | | | |
|---|---|---|---|
| 226,928 | 4/1963 | Austria | 52/479 |
| 513,907 | 10/1939 | United Kingdom | 52/403 |
| 819,531 | 9/1959 | United Kingdom | 52/452 |

*Primary Examiner*—Alfred C. Perham
*Attorney, Agent, or Firm*—Caesar, Rivise, Bernstein & Cohen, Ltd.

[57] ABSTRACT

A modular building wherein the studs and certain other membes are comprised of two half stud members held together by rotating clamps. The half stud members are preferably of identical construction, each including a first longer wall and a second shorter wall, the first and second walls running generally parallel to each other and connected by a bridging section, each wall terminating in a free edge tab portion. The two half stud members are disposed against each other in such a way that the first longer wall of each half stud member is in abutting relationship, such that the respective tabs of the first and second parallel walls extend away from each other, and wherein a vinyl separator is interposed between the abutting first parallel walls. The vinyl separator possesses, at one end, an exterior seal and possesses an interior seal at the other end thereof.

The walls are erected by providing an exterior panel having longitudinal grooves formed in the interior surface adjacent each vertical edge, and a half stud member is attached to the panel at each vertical edge with the tabs of the second parallel walls of the half stud member being received in the longitudinal grooves. The exterior panel with its half studs is then so positioned with respect to a previously erected exterior wall panel (which already has a half stud) that the half stud of the previously erected wall panel and the nearest half stud of the panel about to be erected may be secured together with rotating clamps after a vinyl separator has been interposed between the first parallel walls of the two half stud members.

The clip usable in connection with the present invention enables the half stud members to be simply and securely fastened to a horizontal wall plate and has other fastening functions. The clip essentially comprises a body portion from which a tab portion extends at one end thereof, with a spring finger extending from the other end of the body portion. The clip is adapted to snap into a pair of slots that may exist in abutting walls that are to be secured together. The tab portion is simply slipped into one of the slot pairs, and the spring finger is passed through the other slot pair and allowed to move to a locking position. It will be seen that one of the important uses of the clip is to secure the half stud members to a supporting brace.

2 Claims, 9 Drawing Figures

INVENTOR
WESLEY T. MURPHY

BY

Caesar, Rivise
Bernstein & Cohen

ATTORNEYS.

INVENTOR
WESLEY T. MURPHY
BY
Caesar, Rivise,
Bernstein & Cohen
ATTORNEYS.

INVENTOR
WESLEY T. MURPHY
BY
Caesar, Rivise,
Bernstein & Cohen
ATTORNEYS.

FIG. 4
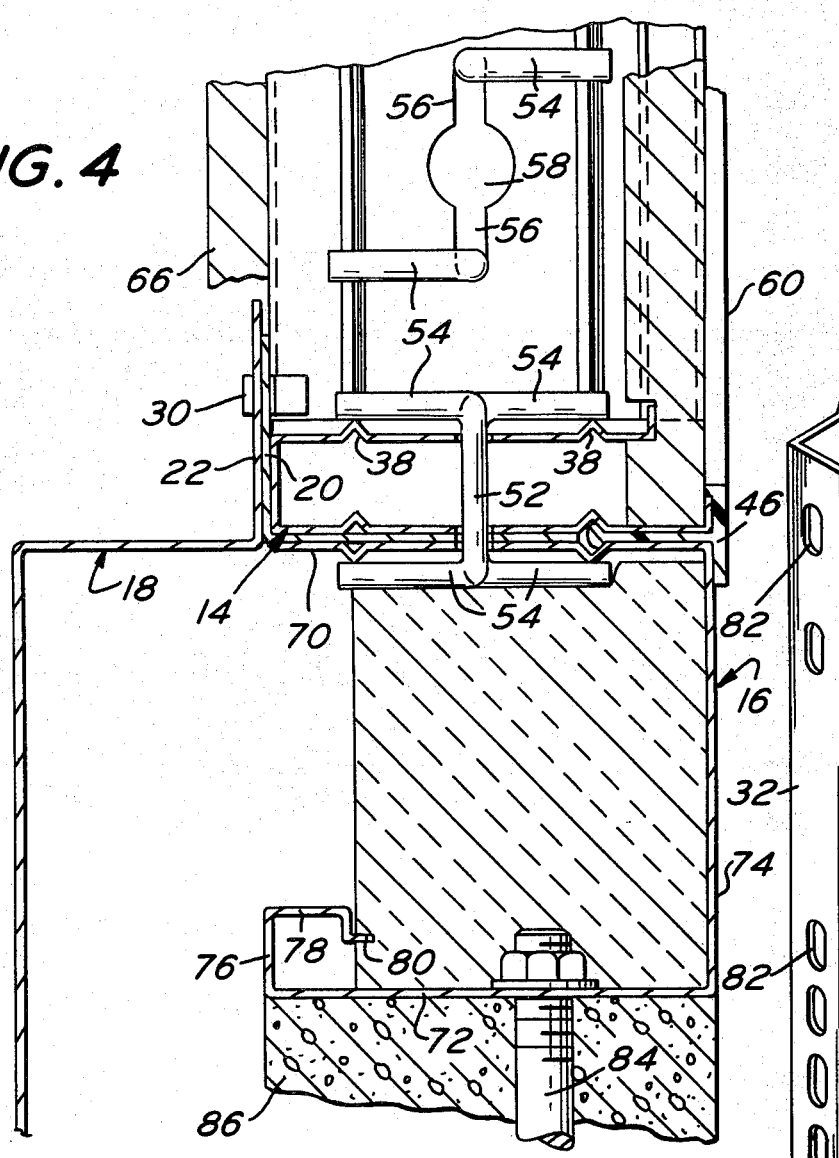
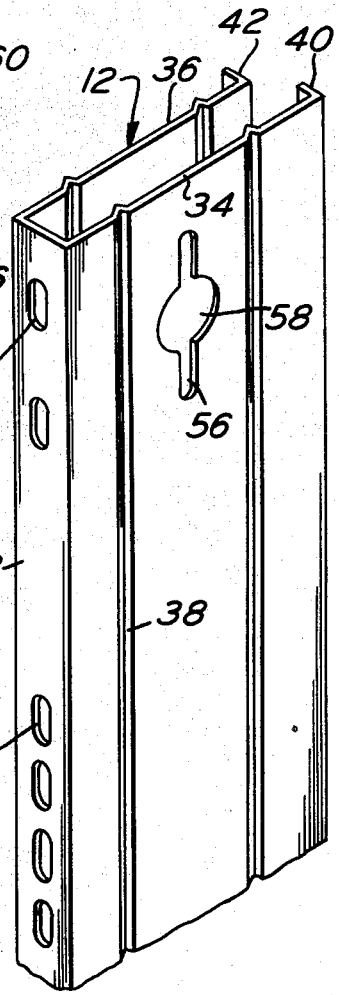
FIG. 8
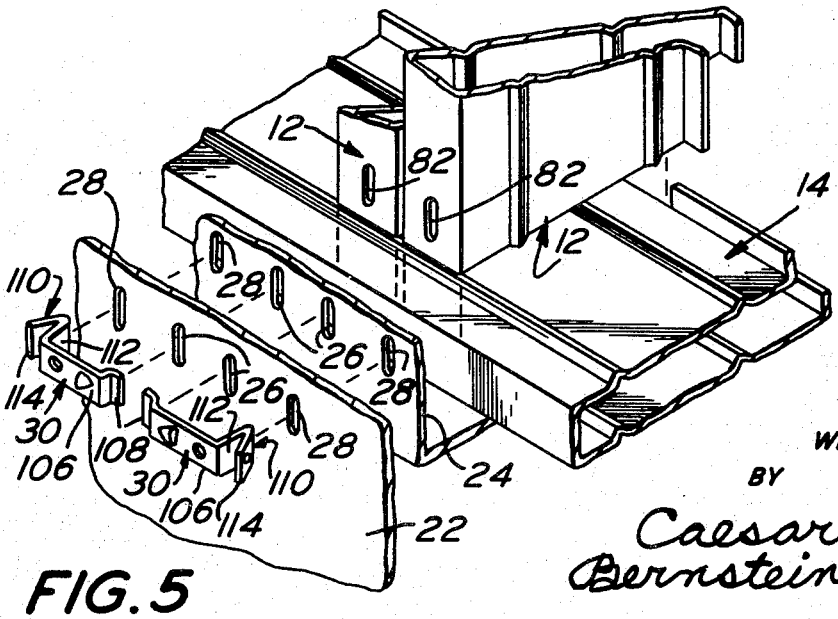
FIG. 5
INVENTOR
WESLEY T. MURPHY
BY
Caesar, Rivise, Bernstein & Cohen
ATTORNEYS.

INVENTOR
WESLEY T. MURPHY

BY

Caesar, Rivise,
Bernstein & Cohen

ATTORNEYS.

MODULAR BUILDING

This is a continuation of application Ser. No. 160,018, filed July 6, 1971, now abandoned, which application is a continuation-in-part application based on pending Application Ser. No. 85,533, filed Oct. 30, 1970 and entitled "Building Structures" now abandoned.

The present invention relates to a modular building and has as its objective the provision of a new and improved building system including the use of novel studs and attachment clips.

A large number of prefabricated and modular housing systems have been formulated over the years, but for various reasons, there has been little acceptance or success with such systems.

The prefabricated systems which have been presented for commercial use are generally comprised of a large number of components that are usually not standardized, and therefore must be constructed by a skilled craftsman with careful attention to plans.

Furthermore, such systems have been generally unattractive in appearance, such that any saving in cost has not proved to be an incentive to the adoption of such systems, particularly in low and middle cost housing.

As the shortage of housing grows, the need has deepened for an effective modular building that can be easily constructed by unskilled workmen at low cost.

The principal object of the invention is to provide novel metal studding and clip members for use in construction whereby a large number of components in a modular building may be quickly assembled in substantially abutting relationship by relatively unskilled labor.

A further object of the present invention is to provide a modular building which utilizes a specially constructed metal studding and clip which can be used to assemble various panels and other members in substantial abutting relationship so that the outer faces thereof will be practically flush.

Another object of the present invention is to provide a novel metal studding and clip that will support and hold together panels and other members in a building without nails or threaded fastening means such that the panel joints are not exposed and do not require the application of spackling, taping or other retaining means.

Still another object of the invention is to provide a modular building embodying novel metal studding and clip means that can be placed into use without relying upon special tools, and wherein the studding and panelling are provided with openings to permit the assembly of electrical wiring, piping, heating and ventilating ducts.

The foregoing as well as other objects of the invention are achieved by providing a modular building involving the use of half stud members held together by rotating clamps, with the half stud members being secured to a horizontal wall plate or other supporting structure by means of the clips of the present invention. The half stud members are held together back to back so that the first longer walls thereof are in abutting relationship. Both the first and second walls of each half stud member are provided with aligned slots, with each slot including an enlarged central portion which permits the passage of a U-shaped clamp that can be rotated so that the legs of the clamp exert an inward pressure on the abutting half stud members.

Other objects and many of the attendant advantages of this invention will be readily appreciated as the same become better understood by reference to the following detailed description when considered in connection with the accompanying drawings wherein:

FIG. 1 is a fragmentary, three-dimensional view showing a pair of half-stud members secured together and, in turn, holding exterior and interior panels, with certain portions of supporting structure being also shown;

FIG. 1-A is a fragmentary, three-dimensional view showing the abutment of a pair of half stud members with the U-shaped clamps having been rotated in place;

FIG. 4 is an enlarged horizontal sectional view taken along the lines 4—4 of FIG. 1;

FIG. 5 is a fragmentary, three-dimensional, exploded view showing the attachment of clips, constructed in accordance with the present invention, to a supporting brace and horizontal wall plate for holding a pair of half stud members;

FIG. 8 is a fragmentary, three-dimensional view showing a single half stud member.

Figure 1:
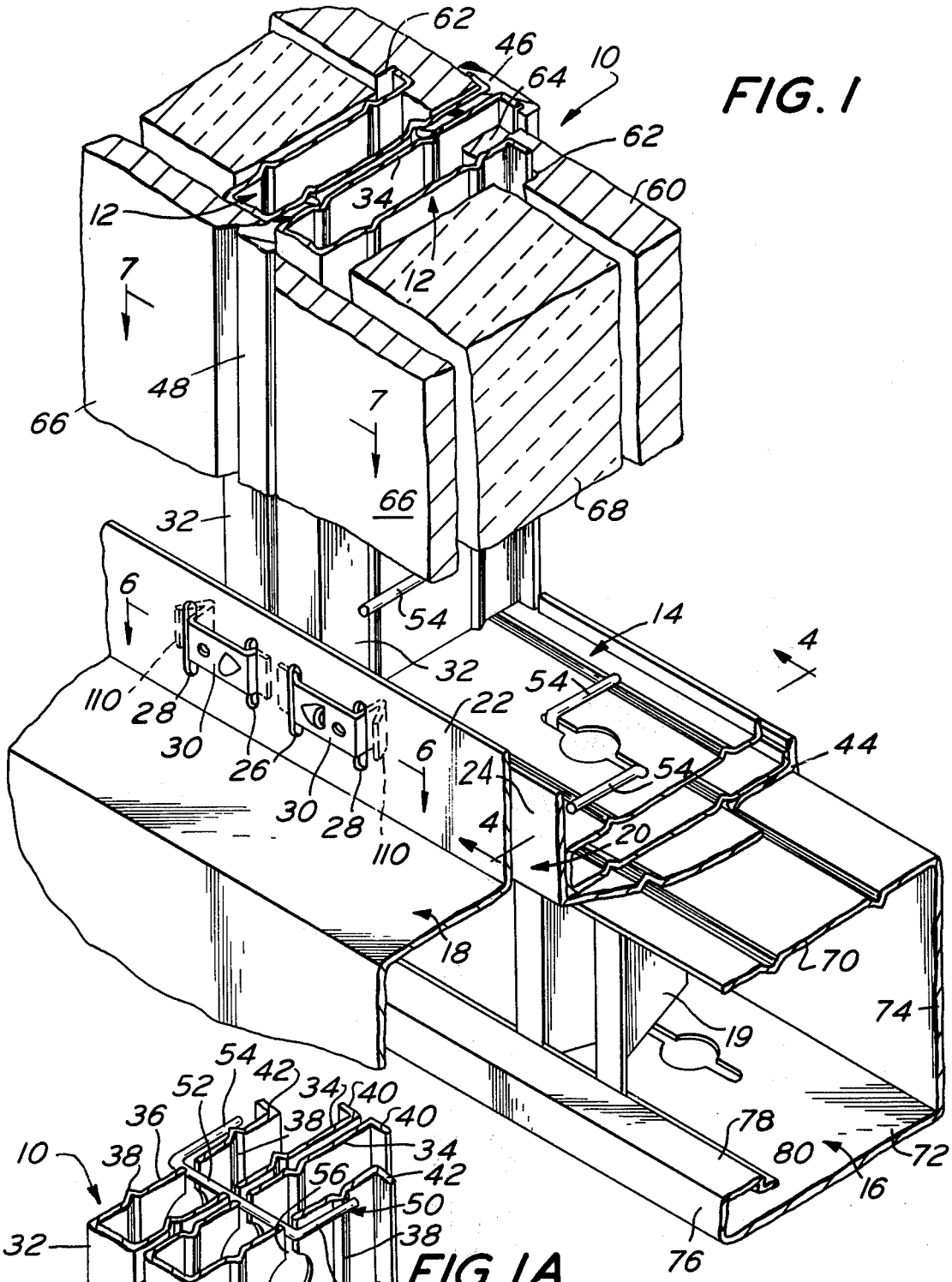
Figure 1A:
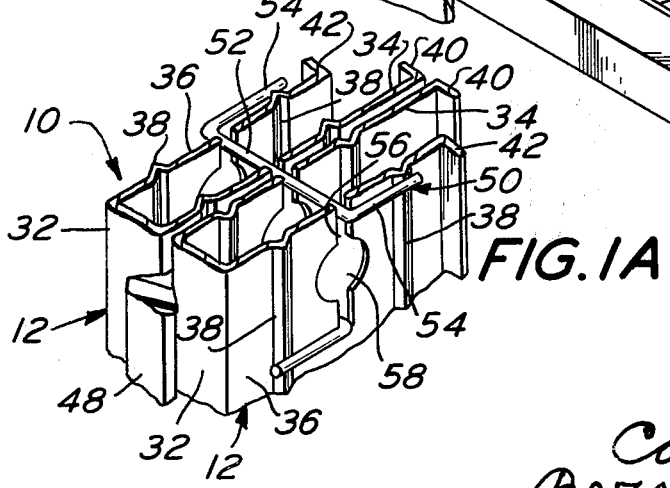

Referring now in greater detail to the various figures of the drawings wherein like reference characters refer to like parts, there is shown generally at 10 in FIG. 1 and FIG. 1-A a pair of half stud members constructed and disposed with respect to each other in accordance with the present invention. As further shown in FIG. 1, the half stud members 12 extend upwardly from horizontal wall plate 14 which is of the same construction as the half stud members 12. The entire construction is supported from sill plate 16 that is bolted to a foundation (not shown), with braces 19 also being utilized for support.

As further shown in FIG. 1, a supporting beam 18 runs upward to meet L-shaped member 20 which rests on the sill plate 16. Both the beam 18 and member 20 respectively have upstanding walls 22 and 24 which are flush with each other. Each of the walls 22 and 24 have first and second slots 26 and 28 formed therein to receive clips 30 in a locking arrangement. The bridging section 32 of each half stud member 12 also possesses slots similar to slots 26 and 28 which coincide with said slots so that the clips 30 will pass into the bridging section 32 thereby to fasten the half stud members 12 to the upstanding walls 22 and 24.

With reference to FIG. 1-A, it will be seen that each half stud member 12 comprises a first longer wall 34 and a second shorter wall 36, with the walls 34 and 36 being generally parallel to each other and possessing longitudinal crimps 38 for locking and strengthening purposes. The walls 34 and 36 are joined by the bridging section 32.

From FIG. 1-A it will be seen that a pair of half stud members are disposed against each other in such a way that the walls 34 of each half stud member are in abutting relationship, such that the respective tabs 40 and 42 extending from the free edges of the walls 32 and 34 will extend away from each other as can be seen in FIG. 1-A.

Furthermore, a vinyl separator is interposed between the mating half stud members in a sealing relationship. Also, there is an enlarged seal member at each end of the vinyl separator 44. One of the seals is somewhat flattened and is designated as exterior seal 46 and the other seal is more rounded and is designated as interior seal 48.

The half stud members 12, together with the vinyl separator 44, including seals 46 and 48, are secured together by means of rotating clamps 50 which are basically U-shaped and are comprised of a base 52 and legs 54. The rotating clamp 50 is inserted through a slot 56 having enlarged central portion 58 so that the legs 54 are in actual contact with at least crimp 38 in each of the second shorter walls 36 of the half stud members 12. As the clamps 50 (FIG. 1-A) are rotated into place, the legs 52 and 54 of the clamps 50 are cammed over onto crimps 38 to provide a good locking action. Where desired, the undersides of the legs 52 and 54 may be notched so that the crimp will be nested in the notch, thereby further stabilizing the rotating clamps which snap into place when fully rotated.

The insertion of the rotating clamp 50 is usually done in such a manner that the legs 54 are passed through the narrow portions of the slot 56 in each of the first and second walls 34 and 36. The clamp 50 is then rotated about base 52 as an axis so that the legs 54 are rotated away from the slot 56 and into a generally horizontal plane as can be seen in FIG. 1-A.

The legs 54 are so dimensioned and spaced with respect to each other that the legs 54 are separated by a distance slightly less than the distance between convex crimps 38 in parallel second shorter walls 36. Thus, as the clamp 50 is rotated into a horizontal plane, the legs 54 exert an inward force upon the second shorter walls 36, thereby to unite the two half stud members and the interposed vinyl separator 44 with seals 46 and 48 into a single unit. In actual practice, two rotating clamps 50 can be used for each lineal foot pair of half stud members 12.

The exterior panels 60 are united, on to the other, in connection with the insertion of a pair of half stud members. The exterior panels 60 possess longitudinal grooves 62 formed in the interior surface adjacent each vertical edge (FIG. 1). A half stud member 12 is attached along each vertical edge of an exterior panel 60 so that the tabs 42 are seated in the grooves 62 of the panel 60 as shown in FIG. 1.

Exterior panel 60, with its attached half stud along each of the two longitudinal edges, is then aligned with respect to a previously erected exterior wall panel 60 which already has a half stud 12. The half stud of the previously erected panel 60 is united to the closely adjacent half stud 12 of the new panel 60 with rotating clamps 50 after vinyl separators have been interposed between first parallel walls 34 of the two half stud members.

The interior panels 66 are then secured by being snapped into place under the inclined undersurface of a pair of adjacent interior seals 48.

Prior to the insertion of the interior panel 66, insulation 68 may be applied interiorally of the exterior panel 60 by adhesive securement wherein there is a tacky adhesive coating on at least a portion of the insulating surface in contact with the interior wall of the exterior panel. From the foregoing, it can be seen that both exterior panels 60 and interior panels 66 are of standard construction and need not be modified to be used in connection with the present invention except for the provision of the grooves 62 in the exterior panel 60.

With further reference to FIG. 1, it will be seen that the sill plate 16 possessess parallel walls 70 and 72 joined by intersecting wall 74. One of the walls 72 has an extension 76 that merges into a ledge 78 which terminates in offset lip 80.

A single half stud member 12 is shown in FIG. 8, including slot 56 and enlarged central portion 58, which functions not only to receive rotating clamps 50, but also allows the passage of wiring, piping, etc. Furthermore, the bridging section 32 includes a plurality of spaced, elongated slots 82 which permit the passage of fastening members.

With reference to FIG. 4, it will be seen that the sill plate 16 is secured by bolts 84 to concrete foundation. 86.

Figure 2:
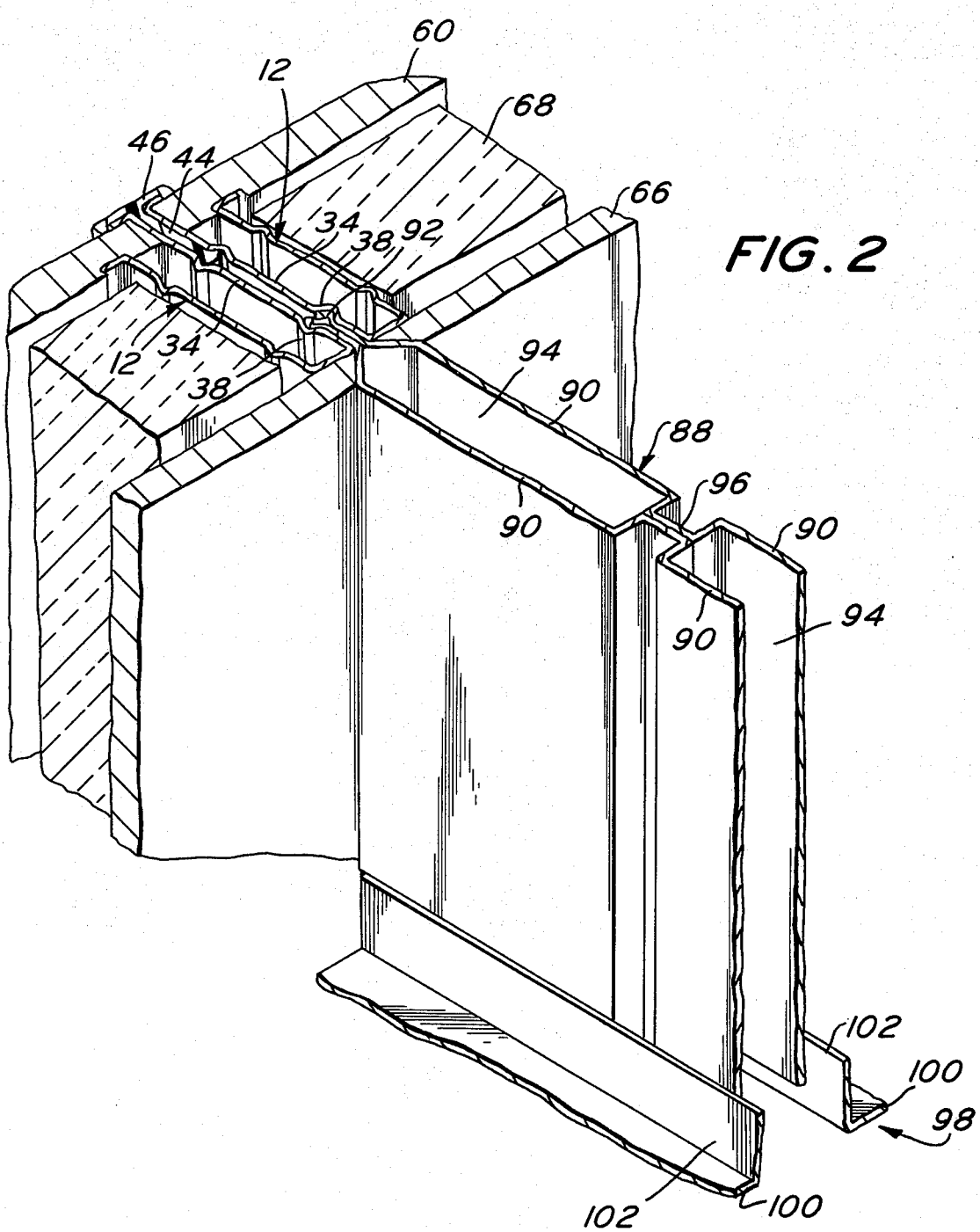
FIG. 2 is a fragmentary, three-dimensional view somewhat similar to FIG. 1 but showing heating and ventilating members in association with a pair of half stud members.

In the embodiment of FIG. 2, a ventilating duct 88 is provided having walls 90 which meet in a bead 92 that is received between the spaces defined by opposing crimps 38 in walls 34 of a pair of mated half stud members 12. The walls 90 define a space 94 through which passes heated or cooled air in a vertical direction.

As further shown in FIG. 2, the walls 90 may be further extended and then constricted in neck portion 96 to be flared out again into additional sections 90 to define another heating or cooling space 94.

The lower edges of the walls 90 are received in, and supported by, a base 98 having supporting legs 100 from which extend retaining walls 102 that receive the walls 90 of the ventilating ducts 88.

Figure 3:
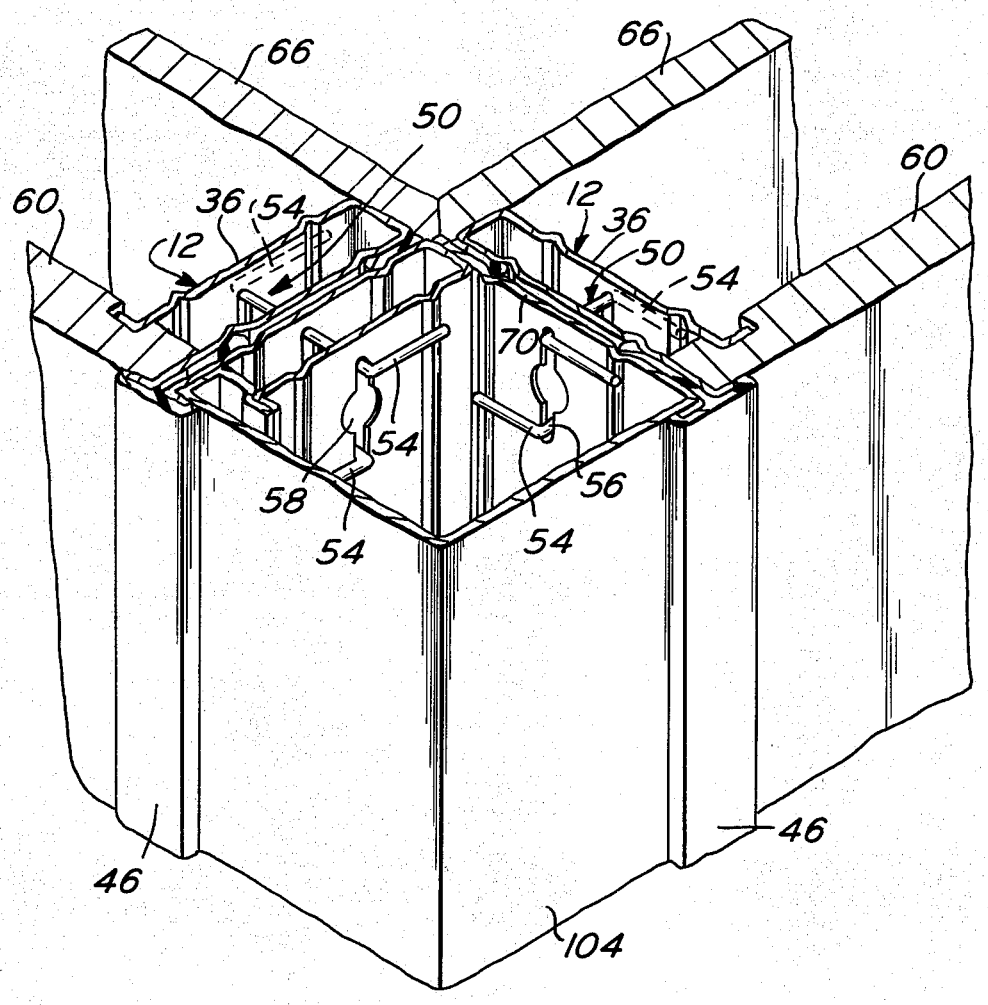
FIG. 3 is a fragmentary, three-dimensional view similar to FIG. 1 showing details of a corner construction.

A corner section is shown in FIG. 3 wherein a three-sided corner piece 104 is provided. Here, single half stud members 12 are joined to the corner section by means of rotating clamps 50 which pass through appropriate aligned slots in both the half stud member 12 and in the corner section 104. As shown in FIG. 3, the corner section 104 has essentially the same shape as the sill plate 16 in FIG. 1, and thus the corner section 104 is generally three-sided in the manner of sill plate 16. Thus, it is necessary to use two half stud members 12 in conjunction with the open end of the corner section 104 (FIG. 3) whereas only one half stud member 12 is necessary in conjunction with the adjacent wall 70 of the corner section 104. In all cases, the rotating clamps 50 are used to fasten the assembly together in a quick and efficient manner, but in FIG. 3, certain of the rotating clamps are narrower since only one half stud member is used on one side of the corner section.

The details of the clips 30 are best shown in FIG. 5 which also shows the aligned slots 26 and 28 in upstanding walls 22 and 24 as well as the aligned slots 82 and the half stud members 12.

The clip 30 essentially comprises a body portion 106 from which a tab portion 108 extends at one end thereof with a spring finger extending at the other end of the body portion 106. The spring finger 110 is essentially V-shaped and consists of an intermediate web 112 terminating in free tab 114.

Figure 6:
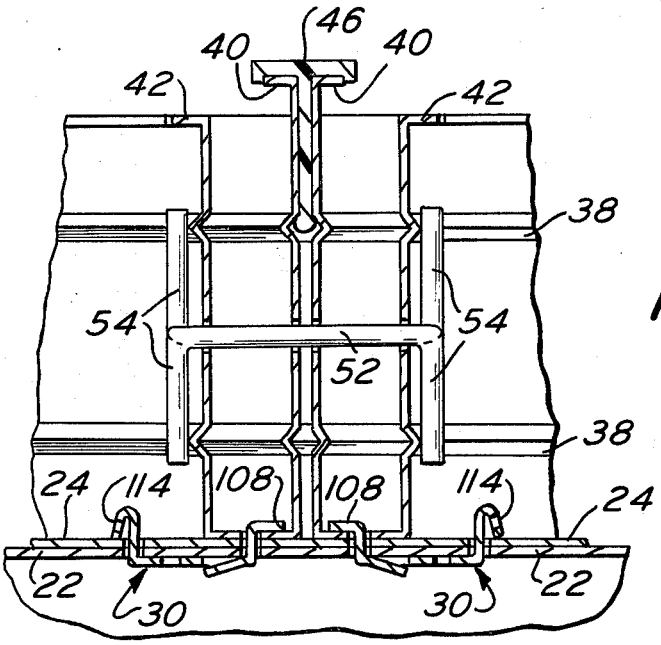
FIG. 6 is an enlarged horizontal sectional view taken along the lines 6—6 of FIG. 1.
Figure 7:
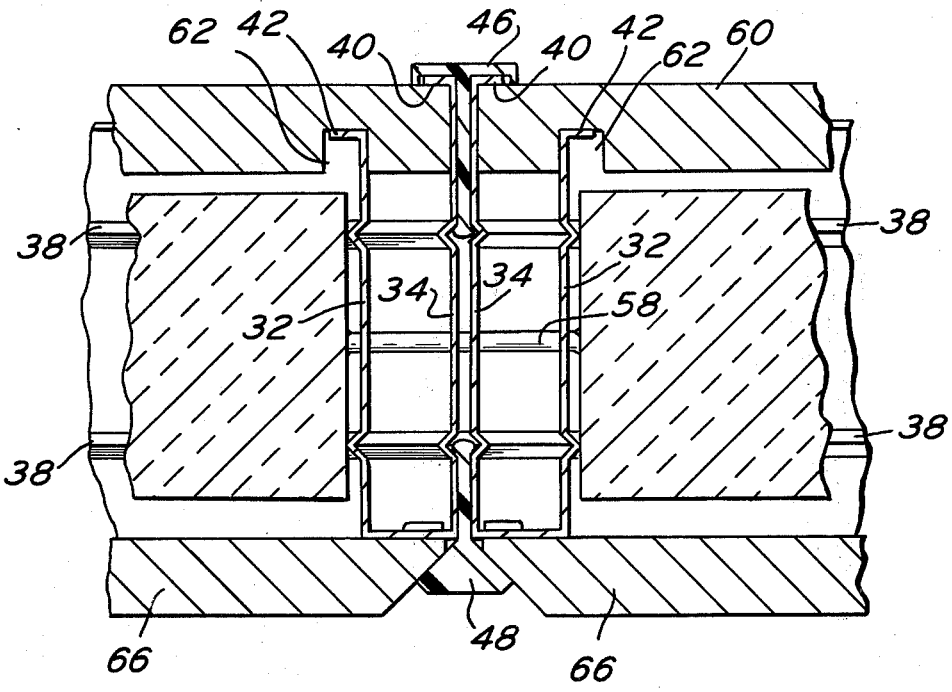
FIG. 7 is an enlarged horizontal sectional view taken along the lines 7—7 of FIG. 1.

The clip 30 is constructed of plain, galvanized sheet metal wherein the free tab 114 can be resiliently urged toward and away from intermediate web 112 which, in turn, may undergo a slight pivotal action at the line where the intermediate web 112 meets with the body portion 106. The insertion of the clip 30 can be appreciated by comparing FIGS. 5 and 1. First, the tab portion 108 is slipped into slots 26 formed in both upstanding walls 22 and 24 and finally into slots 82 in one of the half stud members 12. The clip 30 is now rotated toward the plane of the upstanding walls 22 and 24 as the spring finger 110 is inserted through slots 28 in the upstanding walls 22 and 24. As the body portion 106 approaches actual contact with the upstanding wall 22, the free tab 114 of the spring finger 110 clears upstanding wall 24 so that the free tab 114 will immediately spring away from intermediate web 112 to return to its original position with respect to the web 112. It is thus seen that the clips 30 may be inserted quickly by unskilled labor. The final positioning of the clip 30 can be seen in FIG. 6 wherein the free tab 114 is seated behind upstanding wall 24.

From the foregoing description it can be seen that the present invention is constructed of relatively inexpensive parts and materials, and can be erected rather quickly by relatively unskilled labor. The half stud members 12 are formed from sheet metal using modern high production techniques, and thus production costs are relatively low. The other members usable in the present invention, including supporting beam 18, L-shaped members 20, sill plates 16, corner sections 104 and ventilating ducts 88 are all formed of the same sheet metal under conditions of high production and low cost.

The clip 30 is simply manufactured at high volume rates using appropriate punching and cutting dies.

Without further elaboration, the foregoing will so fully illustrate my invention, that others may, by applying current or future knowledge, readily adapt the same for use under various conditions of service.

What is claimed as the invention is:

1. A building construction comprising at least one stud member secured to a surface, said stud member comprising a first longer wall and a second shorter wall, said longer and shorter walls being generally parallel to each other and connected by a bridging section, said longer wall being adjacent to said surface, resilient means interposed between said longer wall and said surface, said longer and shorter walls and said surface each having aligned slots and clamp means extending through said slots and acting upon at least said shorter wall to urge said longer and shorter walls and said surface inwardly toward each other and applying a compressive force upon said resilient means.

2. The building construction of claim 1 wherein said surface is a second stud member essentially identical with said first stud member and wherein the longer walls of the first and second stud members are adjacent to each other and said resilient means are interposed between said two longer walls, and wherein said clamp means exert inward pressure upon the shorter walls of each of said stud members.

* * * * *